United States Patent [19]

Eck

[11] Patent Number: 5,009,456

[45] Date of Patent: Apr. 23, 1991

[54] DOOR LOCK APPARATUS

[75] Inventor: Berth Eck, Bollebygd, Sweden

[73] Assignee: Lasinvast Svenska AB, Sweden

[21] Appl. No.: 472,202

[22] Filed: Jan. 30, 1990

[30] Foreign Application Priority Data

Feb. 10, 1989 [SE] Sweden ..... 8900450

[51] Int. Cl.[5] ..... E05C 1/16

[52] U.S. Cl. ..... 292/173; 70/256; 292/144; 292/DIG. 25; 292/DIG. 66

[58] Field of Search ..... 292/144, 150, DIG. 65, 292/21, 92, 173, DIG. 25, DIG. 66, 201; 70/465, 256, 257; 340/825.36, 825.32, 825.31

[56] References Cited

U.S. PATENT DOCUMENTS

| | | | |
|---|---|---|---|
| 2,382,062 | 8/1945 | Joachim | 292/173 X |
| 4,200,954 | 5/1980 | McCabe | 292/DIG. 66 X |
| 4,663,626 | 5/1987 | Smith | 70/256 X |
| 4,726,613 | 2/1988 | Foshee | 292/DIG. 66 X |
| 4,825,210 | 4/1989 | Buchhube et al. | 70/256 X |
| 4,854,619 | 8/1989 | Nakauchi | 292/150 X |

*Primary Examiner*—Richard E. Moore

*Attorney, Agent, or Firm*—Lerner, David, Littenberg, Krumholz & Mentlik

[57] ABSTRACT

A door lock apparatus includes a latch bolt which can be displaced from an operable position by actuating a door handle driver against the action of a biasing spring. A displaceable catch is provided for retaining the latch bolt in a retracted position. The catch is biased by a second spring into its catch position from which it can be displaced by an electromagnetic actuator, which in turn is connected to a wireless signal receiver. An alarm detector, remotely placed from the lock apparatus and connected to a wireless signal transmitter, is adapted to be activated when the detector detects a state of alarm, sending a signal which is detectable by the receiver at the lock apparatus for displacing the catch out of its catch position.

13 Claims, 3 Drawing Sheets

DOOR LOCK APPARATUS

FIELD OF THE INVENTION

The present invention relates to a door lock apparatus, comprising a latch bolt, which can be actuated from an operable position by means of a door handle driver against the action of a spring means.

STATE OF THE ART

In many applications it is desirable that door may be opened and closed without the need for manipulation of a pivotally mounted handle for a latch bolt. One field of application for such doors is, for example, for hospital wards and similar premises where one wants to be able to open and close a door with a minimum of noise. In relation to this, a problem exists if fire and building regulations requires that a latch bolt must be present to prevent the door from blowing open in case of an explosion in the area enclosed by the door. Such regulations are normal for hospital ward doors, because hospital ward doors normally contain equipment for administration of oxygen.

OBJECTS OF THE INVENTION

One object of the present invention is to provide a door lock apparatus, which meets both the demands for silent passage through the door, and the demands for a blocking facility in case of a fire.

SUMMARY OF THE INVENTION

These objects are accomplished according to the invention, by providing the door lock apparatus with a catch means for the latch bolt, said catch means being biased by a second spring means into its catch position from which it can be displaced by means of an actuator which is connected to a wireless signal receiver, and an alarm detector, remotely placed from the lock apparatus, and connected to a wireless signal transmitter, which is adapted to be activated when the detector detects a state of alarm, so that a signal is sent which is detectable by the receiver at the lock apparatus, for displacing the catch means out of its catch position.

According to one preferred embodiment of the invention, the actuator comprises an electromagnet.

Preferably, the second spring means comprises a bimetal or memory metal spring, which is connected to the catch means and adapted to displace it out of its catch position when the temperature rises above a certain predetermined level.

Preferably, the receiver obtains a supply of current via a solar cell in connection with a rechargeable battery.

According to another preferred embodiment of the invention, the transmitter is connected to means for activation of more than one selectable transmitter frequency.

BRIEF DESCRIPTION OF THE DRAWINGS

One embodiment of the invention will now be described in more detail in the following, with reference to the accompanying drawings, in which.

DESCRIPTION OF A PREFERRED EMBODIMENT

Figure 1:
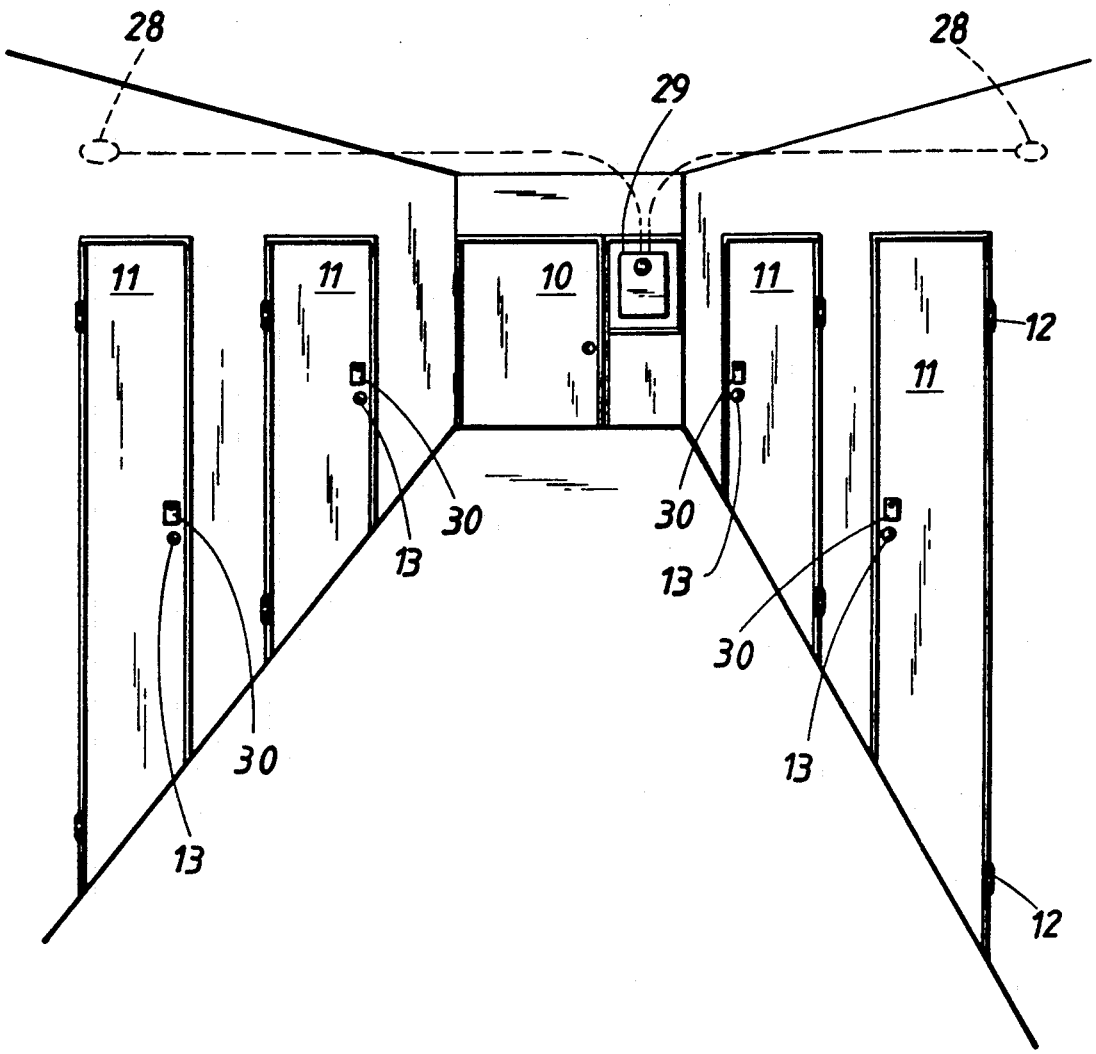
FIG. 1 shows a hospital ward corridor with doors equipped with a lock apparatus according to the invention, FIG. 2 in a larger scale shows the lock apparatus according to the invention, in a first mode of use.

The corridor shown in FIG. 1 is assumed to belong to a wing in a hospital. The corridor is ended by an entrance and exit door 10 into an elevator shaft or staircase and is provided with four doors 11 into a corresponding number of wards. The doors 11 have conventional hinges 12 and handles 13.

Normally these doors lack any latch bolt and trigger. Also, doors exist having a lock apparatus where the latch bolt is mechanically blocked in an inner position, thereby eliminating the noise associated with latch bolt movement while opening and closing these doors.

Figure 2:
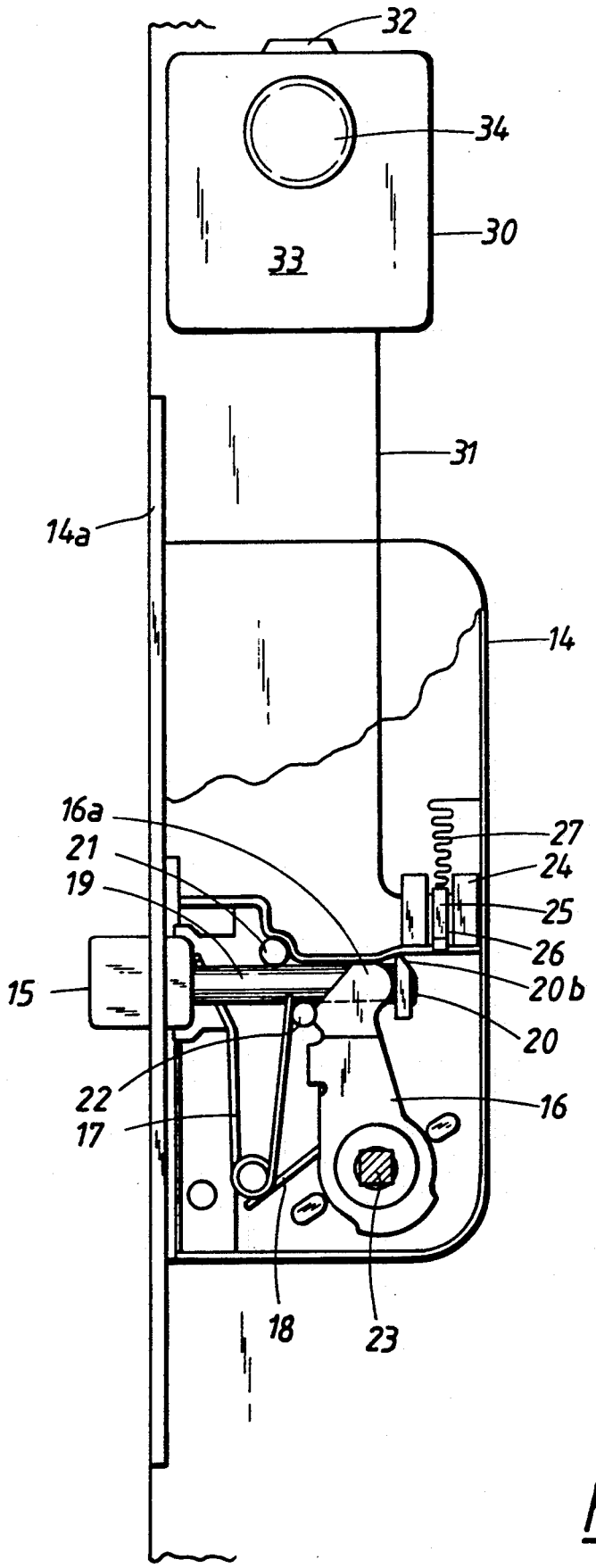
Figure 3:
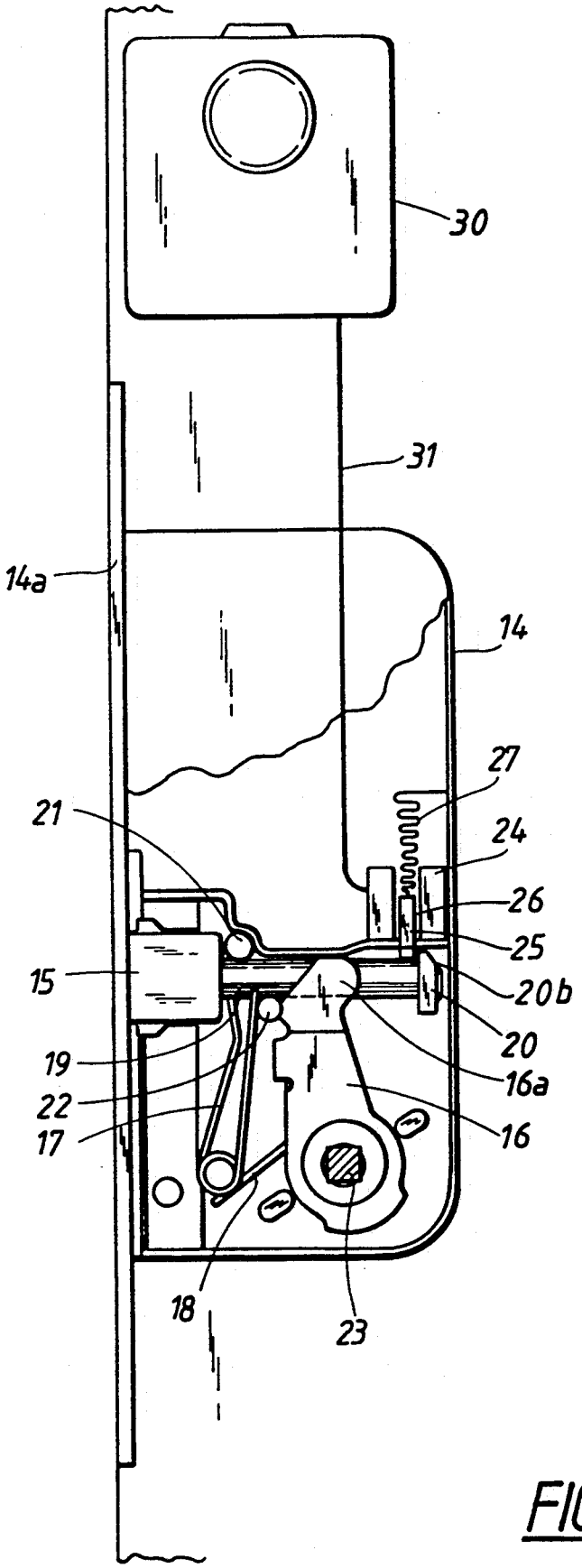
FIG. 3 shows the lock apparatus in FIG. 2 in a second mode of use.

In accordance with the present invention, the doors are each equipped with a lock apparatus 14 which includes a latch bolt 15 and a handle driver 16, as shown in FIGS. 2 and 3. The lock apparatus 14 is also conventionally provided with two spring means 17 and 18 for pressing the latch bolt 15 axially out into an opening in the forend plate **14*a* and for rotation of the handle driver 16 to its normal position of rest, respectively. The latch bolt 15 comprises a shaft 19 and a head 20, which forms the attack surface for the actuator arm 16*a* of the handle driver 16. The latch bolt is guided between two cross bolts 21, 22, which together with the edges of the forend plate 14*a*** defines the axial path of movement of the latch bolt.

The handle driver 16 is pivotally journalled in the lock apparatus and may be operated by means of a handle, which is not shown in the drawings, via a square section bolt 23, so that the latch bolt can be pulled into the lock housing as is shown in FIG. 3, when the door handle is operated, i.e. when the handle driver is turned clockwise in the drawings.

The lock housing 14 is also provided with a catch means which comprises an electromagnet 24 and catch 25 which can be manipulated by said electromagnet 24. The catch 25 is axially movable in a channel 26 in the electromagnet 24 and normally biased by means of a spring 27, made of memory metal, in the direction downward in FIG. 2 and 3.

Because the head 20 of the latch bolt 15 is provided with a bevelling **20*b*, the head can be moved past the catch 25 to the position shown in FIG. 3**, wherein the latch bolt is in a latching position.

During normal conditions, the latch bolt is held in the position shown in FIG. 3, in order to facilitate opening and closing of the door without disturbing noise.

However, in case of a fire, the latch bolt must be operable, in order to prevent the door from being blown open by a rapid change in pressure, e.g. because of an explosion in the room enclosed by said door.

As FIG. 1 shows, smoke and fire detectors 28 are placed in the rooms which are enclosed by the doors 11. The detectors 28 are connected to a common alarm central 29. This central is provided with a wireless signal transmitter, well known in the art, and which does not need to be elaborately described.

When the alarm central 29 indicated a state of smoke or fire, the trnasmitter is activated and sends a wireless signal in the direction of the corridor, This signal is detected by a wireless signal receiver 30 placed on each respective door 11.

In this respect, the transmitter may be so arranged that it transmits signals of select frequencies to individual doors, or alternatively, signals which are detectable by all signal receivers 30.

The signal receiver 30 is shown in greater detail in FIG. 2 and 3 and is placed adjacent the lock housing 14, in order to minimize the wire laying. One wire 31 runs between the receiver and the electromagnet 24 mounted within the lock housing. A relay in the receiver 30 is activated by the wireless signal and supplied activating current to the electromagnet from a source of energy mounted within the receiver. The electromagnet 24 now pulls the catch 25 against the action of the bimetal spring 27 and the latch bolt 15 can be pushed out into a striking plate in the adjacent door frame (see FIG. 2), by the action of the hairpin spring 17.

In this position, the door can be opened conventionally by manipulating the latch bolt by means of the handle driver 16.

In case of a false alarm or the like, the alarm condition can be interrupted at the alarm central 29. This breaks the current to the electromagnet 24, and the latch bolt 15 will return to the position shown in FIG. 3 the next time the trigger is manipulated for opening of the door.

If the fire should be so intensive that the heat will damage the electrical components in the receiver 30 or the lock housing 14, the current to the electromagnet might be broken. Now, if athe door would be opened by means of the handle, the latch bolt could accidentally be caught by the catch 25 in its inoperative position, which would not be desirable. However, the memory metal spring 27 is adapted to react upon the rising temperature and pull the catch 25 out of its catch position.

The receiver 30 is provided with a front wall 33 which noramlly is locked by a lock 32. A solar cell 34 is mounted on the outside of said front wall. The solar cell is connected to a rechargeable battery, which is adapted to sustain a supply of energy to the electromagnet 24 during a temporary break in the supply of energy, when the solar cell does not get enough light.

Preferably, the wireless communication between the transmitter and the receiver will be made by radio waves. Other types of carrier waves are also possible.

The invention is not limited to the above described embodiment, but several modifications are possible within the scope of the accompanying claims. For example, the apparatus according to the invention may be adapted for other fields of use than shown, e.g. in factory plants and laboratories. The lock apparatus and the catch means can be designed differently than shown.

What I claim:

1. A door lock apparatus comprising, a latch bolt, first spring means for biasing said latch bolt into a latching position, a door handle driver for retracting said latch bolt from said latching position to a retracted position, catch means displaceable between a catch position for retaining said latch bolt in said retracted position and an inoperable position, second spring means for biasing said catch means into said catch position, an actuator for displacing said catch means from said catch position to said inoperable position, an alarm detector remotely placed from said lock apparatus for detecting a state of alarm, a signal transmitter connected to said alarm detector and adapted to transmit a signal when said alarm detector detects said state of alarm, and a signal receiver connected to said actuator and adapted to receive said signal, whereby upon receipt of said signal by said signal receiver said actuator displaces said catch means from said catch position to said inoperable position.

2. An apparatus as claimed in claim 1 further comprising, a rechargeable battery cell and a solar cell for providing a supply of current to said receiver.

3. An apparatus as claimed in claim 1 wherein said signal transmitter is adapted to transmit signals of more than one select frequency.

4. An apparatus as claimed in claim 1 wherein said actuator comprises an electromagnet.

5. An apparatus as claimed in claim 4 wherein said second spring means comprises a memory metal spring adapted to displace said catch means from said catch position to said inoperable position upon an increase in temperature above a predetermined level.

6. An apparatus as claimed in claim 5 wherein said signal transmitter is adapted to transmit signals of more than one select frequency.

7. An apparatus as claimed in claim 5 further comprising, a rechargeable battery cell and a solar cell for providing a supply of current to said signal receiver.

8. An apparatus as claimed in claim 7 wherein said signal transmitter is adapted to transmit signals of more than one select frequency.

9. An apparatus as claimed in claim 1 wherein said second spring means comprises a memory metal spring adapted to displace said catch means for said catch position to said inoperable position upon an increase of temperature above a predetermined level.

10. An apparatus as claimed in claim 9 wherein said memory metal spring comprises a bimetal spring.

11. An apparatus as claimed in claim 9 wherein said signal transmitter is adapted to transmit signals of more than one select frequency.

12. An apparatus as claimed in claim 9 further comprising, a rechargeable battery cell and a solar cell for providing a supply of current to said signal receiver.

13. An apparatus as claimed in claim 12 wherein said signal transmitter is adapted to transmit signals of more than one select frequency.

* * * * *

UNITED STATES PATENT AND TRADEMARK OFFICE

CERTIFICATE OF CORRECTION

PATENT NO. : 5,009,456

DATED : April 23, 1991

INVENTOR(S) : Berth Eck

It is certified that error appears in the above-identified patent and that said Letters Patent is hereby corrected as shown below:

On the title page, under Foreign Application Priority Data, "8900450" should read --8900450-1--.

Column 2, line 62 "indicated" should read --indicates--.

Column 2, line 63 "trnasmitter" should read --transmitter--.

Column 3, line 28 "athe" should read --the--.

Column 4, line 44 "for" should read --from--.

Signed and Sealed this

Twenty-second Day of September, 1992

*Attest:*

DOUGLAS B. COMER

*Attesting Officer*

*Acting Commissioner of Patents and Trademarks*